US007536816B2

(12) United States Patent
Weinberger

(10) Patent No.: US 7,536,816 B2
(45) Date of Patent: May 26, 2009

(54) FIREARM MAGAZINE WITH STATUS INDICATOR

(75) Inventor: Yoav Weinberger, Haifa (IL)

(73) Assignee: Hamafteach Hamistovev Ltd., Haifa (IL)

( * ) Notice: Subject to any disclaimer, the term of this patent is extended or adjusted under 35 U.S.C. 154(b) by 398 days.

(21) Appl. No.: 10/538,737

(22) PCT Filed: Nov. 9, 2003

(86) PCT No.: PCT/IL03/00933

§ 371 (c)(1),
(2), (4) Date: Jun. 14, 2005

(87) PCT Pub. No.: WO2004/055465

PCT Pub. Date: Jul. 1, 2004

(65) Prior Publication Data

US 2006/0053671 A1 Mar. 16, 2006

(30) Foreign Application Priority Data

Dec. 16, 2002 (IL) ..... 153465

(51) Int. Cl.
*F41A 9/62* (2006.01)

(52) U.S. Cl. ..... 42/1.02; 42/50

(58) Field of Classification Search ..... 42/1.01–1.02, 42/49.01

See application file for complete search history.

(56) References Cited

U.S. PATENT DOCUMENTS 387,531 A * 8/1888 Miller ..... 42/49.01
784,786 A 3/1905 Gottardi
4,100,691 A 7/1978 Wicklund
4,142,313 A 3/1979 Musgrave
4,219,953 A 9/1980 Musgrave
4,587,756 A 5/1986 Jakubaschk et al.
4,831,761 A * 5/1989 Kulakow ..... 42/50
5,052,139 A 10/1991 Marzocco
5,291,679 A 3/1994 Wollack et al.
5,309,660 A * 5/1994 Blackamore ..... 42/50

OTHER PUBLICATIONS

International Search Report for PCT/IL03/00933 dated Apr. 15, 2005.

* cited by examiner

*Primary Examiner*—Troy Chambers
(74) *Attorney, Agent, or Firm*—Pearl Cohen Zedek Latzer, LLP

(57) ABSTRACT

A firearm magazine with loading status indicator. the magazine comprising a housing (1) for storing bullets in a stacked configuration, with an opening (6) for receiving the bullets (5); a follower (3) for supporting the bullets within the housing, movable along the housing and resiliently pressing towards the opening, so that at any time, when there exist at least one bullet within the housing it is presented at the opening, ready to be discharged; an indicator having a prominence (7), which in one indication state the prominence protrudes outside the housing and in another indication state the prominence does not protrude outside the housing, wherein one of the indication states corresponds to a state where the magazine is in a full condition, that is when it is filled with bullets up to a maximal capacity, and another indication state corresponding to a state where at least one bullet is missing with respect to full condition.

28 Claims, 16 Drawing Sheets

FIREARM MAGAZINE WITH STATUS INDICATOR

CROSS-REFERENCE TO RELATED APPLICATIONS

This application is a National Phase Application of PCT International Application No. PCT/IL2003/000933, International Filing Date Nov. 9, 2003, which claims priority from IL Patent Application, 153465, filed Dec. 16, 2002.

FIELD OF THE INVENTION

The present invention relates to firearms. More particularly it relates to a magazine with a status indicator.

BACKGROUND OF THE INVENTION

In modern firearms the magazine is used as a container for bullets, which are stored in it until use. A magazine also serves as a feeder of bullets into the firearm's muzzle.

Firearms are lethally dangerous, and many cases were inadvertent firing had caused injuries or deaths are reported. In many of these cases it appeared that the persons handling the firearms were unaware of the presence of bullets in the firearm's muzzle.

In order to address this problem in some new designs of firearms a pin was added to the body of the firearm, which protrudes when a bullet is present inside the muzzle, indicating the dangerous status of the firearm. This is indeed a good solution, but is only applicable in newly manufactured firearms, and renders the manufacture of such firearms more costly and complicated. However, this solution is not applicable in existing firearms, and not for all types and models of firearms, like rifles, machine guns, sub-machine guns etc.

U.S. Pat. No. 4,587,756 (Jakubaschk et al.) disclosed a magazine for small arms with indication for the loading status of the magazine, comprising a viewing opening through which the follower spring is visible, and by counting the number of coils visible, the number of bullets inside the magazine may be determined.

In U.S. Pat. No. 4,219,953 (Musgrave) a sonic indicator was provided in a magazine, indicating that the magazine is empty when rattling.

U.S. Pat. No. 4,142,313 (Musgrave) disclosed a magazine with indicators indicating if the magazine is empty, if it contains only one bullet or if it is full.

U.S. Pat. No. 5,052,139 (Marzzoco) disclosed an indicator device incorporated with the barrel of a shotgun, indicating the presence of a cartridge in the cartridge chamber of the gun.

In U.S. Pat. No. 4,100,691 (Wicklund) an indicator is incorporated in the gun breech bolt indicating the presence of a bullet inside.

In U.S. Pat. No. 5,291,679 (Wollack et al.) there was disclosed a magazine with an elongated indicator member attached to the follower and projecting outside the body of the magazine so that the length of the indicator member indicates how many bullets remain in the aperture. The indicator member is provided with a series of knots at predetermined intervals so that the number of knots on the portion of the indicator member projecting outside the body of the magazine equals the number of bullets remaining in the magazine. This is indeed a nice way of finding out how many bullets are inside the magazine at a given time, yet this information is not really what interests the weapon bearer. It is by far more important for the gun bearer to get information concerning the presence of a bullet in the muzzle of the firearm. Moreover, the indicator member seems rather awkward and cumbersome, with a lengthy indicator hanging from the magazine that may inadvertently be pulled or engaged to the hand of the user or to other items, rendering the use of the magazine unsafe.

Practically most weapon bearers keep their magazines filled with bullets, leaving no room for extra bullets. As most of the time firearms are not used, but rather kept ready for use, an indication that the magazine is not fully loaded may literally save lives.

It is a purpose of the present invention to provide a novel magazine with an indicator for indicating the filling status of the magazine, i.e. indicating if the magazine is full with bullets or not. This in mainly in order to provide a warning to the firearm bearer as to the possibility of a bullet being present inside the muzzle of the firearm.

Yet another purpose of the present invention is to provide such magazine with an indicator for indicating the filling status of the magazine that can be used in many types or models of firearms.

Another purpose of the present invention is to provide the holder of a firearm with a fast and reliable indication of the filling status of the magazine even when it is inserted in the accommodating slot of the firearm.

BRIEF DESCRIPTION OF THE INVENTION

There is thus provided, in accordance with a preferred embodiment of the present invention, a firearm magazine with loading status indicator, the magazine comprising:

a housing for storing bullets in a stacked configuration, with an opening for receiving the bullets, a follower for supporting the bullets within the housing, movable along the housing and resiliently pressing towards the opening, so that at any time, when there exist at least one bullet within the housing it is presented at the opening, ready to be discharged;

indicator having a prominence, which in one indication state the prominence protrudes outside the housing and in another indication state the prominence does not protrude outside the housing, wherein one of the indication states corresponds to a state where the magazine is in a full condition, that is when it is filled with bullets up to a maximal capacity, and another indication state corresponding to a state where at least one bullet is missing with respect to the full condition.

Furthermore, in accordance with a preferred embodiment of the present invention, the prominence cooperates with the follower, so that when the magazine is in full condition the prominence protrudes outside a bore in the housing, and when at least one bullet is missing with respect to the full condition the prominence does not protrude.

Furthermore, in accordance with a preferred embodiment of the present invention, the prominence cooperates with the follower, so that when the magazine is in full condition the prominence does not protrude outside a bore in the housing, and when at least one bullet is missing with respect to the full condition the prominence protrudes outside the bore.

Furthermore, in accordance with a preferred embodiment of the present invention, the prominence is linked to follower.

Furthermore, in accordance with a preferred embodiment of the present invention, the prominence is replaceable.

Furthermore, in accordance with a preferred embodiment of the present invention, the prominence is provided on an end of a resilient lever pivotally attached to the housing, cooperating with the follower.

Furthermore, in accordance with a preferred embodiment of the present invention, a second prominence is provided on another end of the resilient lever, so that when one prominence protrudes through the bore the second prominence is hidden, and when the one prominence is hidden the second prominence protrudes through a second bore at the housing.

Furthermore, in accordance with a preferred embodiment of the present invention, each prominence is colored distinctly.

Furthermore, in accordance with a preferred embodiment of the present invention, each prominence is distinctly shaped.

Furthermore, in accordance with a preferred embodiment of the present invention, each prominence has a different protrusion length.

Furthermore, in accordance with a preferred embodiment of the present invention, the indicator comprises a floating member with a prominence.

Furthermore, in accordance with a preferred embodiment of the present invention, the floating member is resiliently supported.

Furthermore, in accordance with a preferred embodiment of the present invention, a shock absorbing feature is incorporated in the indicator.

Furthermore, in accordance with a preferred embodiment of the present invention, the shock absorbing feature comprises a spring.

Furthermore, in accordance with a preferred embodiment of the present invention, the shock absorbing feature comprises a pin with a resilient structure.

Furthermore, in accordance with a preferred embodiment of the present invention, the shock absorbing feature comprises a pin made of elastic material.

Furthermore, in accordance with a preferred embodiment of the present invention, indicator is located on a bottom wall of the magazine.

Furthermore, in accordance with a preferred embodiment of the present invention, the indicator is located on a lateral wall of the magazine.

Furthermore, in accordance with a preferred embodiment of the present invention, the indicator comprises a plurality of indicators.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF THE INVENTION AND DRAWINGS

A main aspect of the present invention is the provision of a firearms magazine with status indicator indicating the filling status of the magazine, namely indicating if the magazine is full with bullets or lacks bullets.

Another aspect of the present invention is the provision of an indicator, which distinctly indicates that the magazine is full or that it lacks bullets (even when as little as one bullet is lacking). This is an important characteristic of the present invention, as it provides the firearm bearer with indication to the probable (or certain) presence of a bullet inside his muzzle, making him more cautious and aware of the status of the firearm.

It is asserted that most of the time a firearm and its magazines are kept idle (not in use), either stored or carried by the owner, whereas the time it is actually used is substantially shorter (accounts for only a tiny fraction of the idle time). Therefore, most of the time, the owner of the firearm is concerned whether there is a bullet inside the muzzle, rendering the firearm dangerous and ready to fire.

In order to tackle this problem the present invention introduces a magazine with a status indicator, which specifically addresses this problem by providing a status indicator, which informs the weapon bearer if the magazine is fully loaded or if a bullet is missing (especially the first bullet)—a fact that ought to raise a suspicion (or understanding) that a bullet is present in the weapon's muzzle.

It is noted that the patents mentioned hereinabove are aimed at either providing information as to the exact number of bullets in the magazine or indication whether the magazine is empty or not. The present invention seeks to provide an indicator having particular value in terms of safety, by indicating the immediate status change between a fully loaded magazine, i.e. indicating that the weapon itself is not cocked, and a deficit of a bullet, indicating that there is a high probability that the weapon is cocked.

Figure 1:
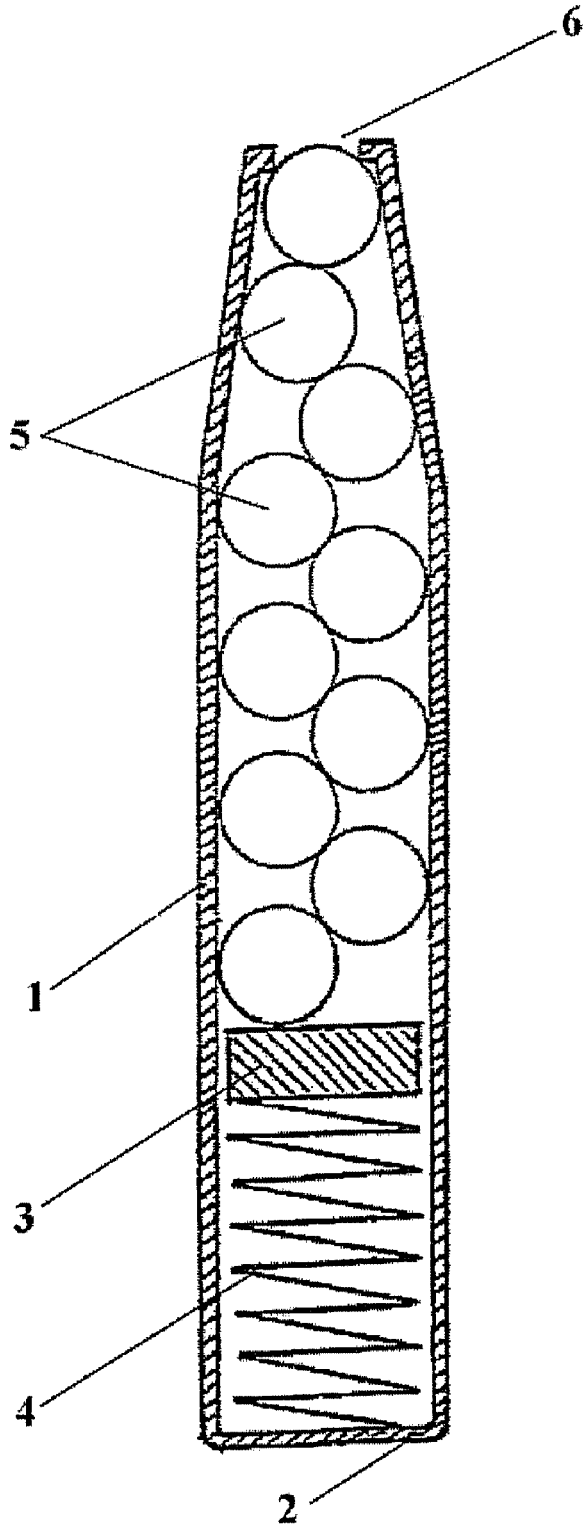
FIG. 1 illustrates a typical firearms magazine (prior art).

A magazine 1 (see FIG. 1) generally comprises a housing 2 defining a cavity in which bullets 5 are stacked in an orderly manner. Housing 2 is provided with opening 6 through which bullets 5 are loaded into or discharged from housing 2. A follower 3 is provided inside magazine 1 resiliently pressing against opening 6, on which the first bullet rests, and as the bullets are loaded into the magazine (one by one), the follower retracts within the magazine to make room for the inserted bullets. Spring 4 provides a counter-force, pressing follower 3 towards opening 6. The last bullet to be inserted is positioned adjacent the opening, available for loading into the muzzle of the firearm. When the magazine is inserted into the magazine cavity of the firearm, the last bullet to be inserted into the magazine is the first one to be loaded into the muzzle of the firearm, when it is loaded.

The present invention is explained hereinafter with reference to some embodiments illustrated in the accompanying figures. Note, however, that the scope of the present invention is not limited to these embodiments alone.

Figure 2:
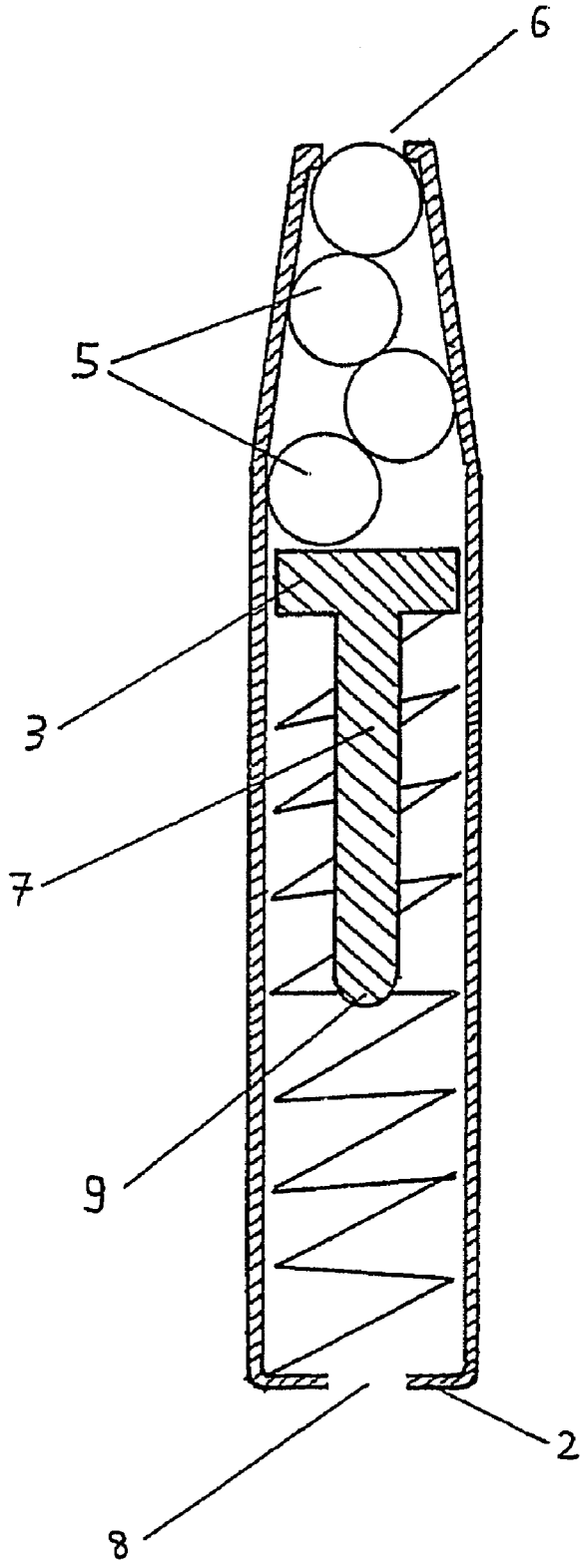
FIG. 2 illustrates a firearms magazine with status indicator in accordance with a preferred embodiment of the present invention, partially loaded.

Reference is now made to FIG. 2 illustrating a firearms magazine with status indicator in accordance with a preferred embodiment of the present invention, partially loaded. Follower 3 is provided with a pin 7, the pin coupled to the follower and having an end 9, the length of the pin calculated to be a bit longer than the distance between the bottom of follower 3 and bore 8, provided at the bottom of housing 2 when the magazine is in full condition, so that when the magazine is fully loaded the pin is designed to protrude through matching bore 8. When the magazine is only partially loaded (i.e. when the magazine lacks one or more bullets from the maximum possible number of bullets that the magazine can contain) end 9 retracts and disappears inside the magazine. In other words, the last bullet to be charged into the magazine causes the indicator pin to protrude through bore 8, whereas when this bullet is discharged it causes the indicator pin to retract and disappear into the magazine housing.

Figure 3:
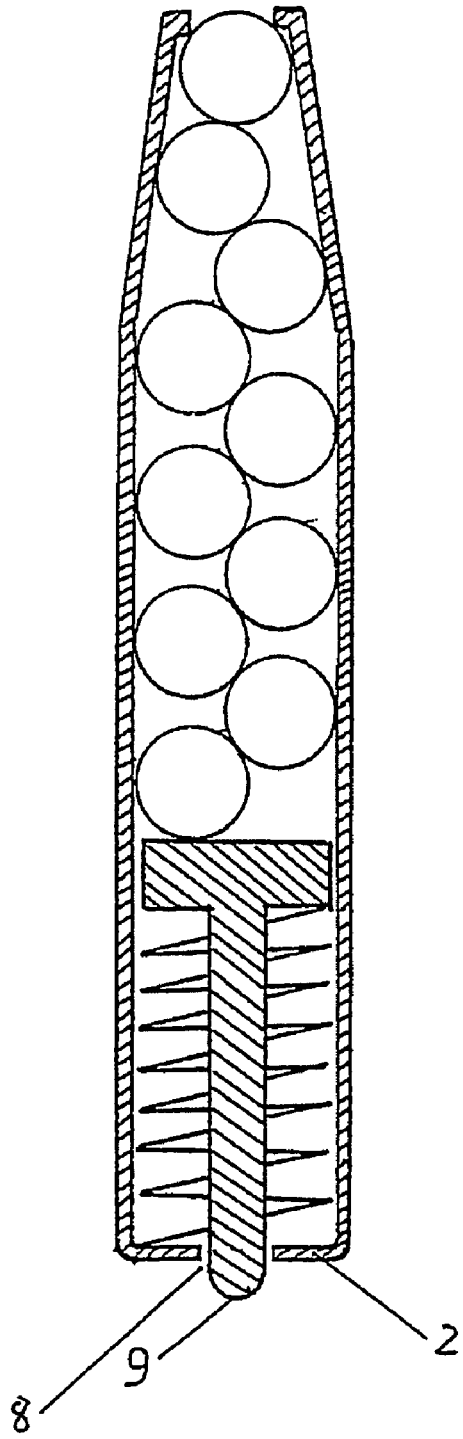
FIG. 3 illustrates a firearms magazine with status indicator in accordance with a preferred embodiment of the present invention, fully loaded.

FIG. 3 illustrates a firearms magazine with status indicator in accordance with a preferred embodiment of the present invention, fully loaded. In this case tip 9 of pin 7 protrudes through bore 8, and is visible. Moreover, it is possible to feel the tip when passing a finger (or any other body part) over bottom of the magazine, and thus determine whether the magazine is fully loaded or not.

Figure 4:
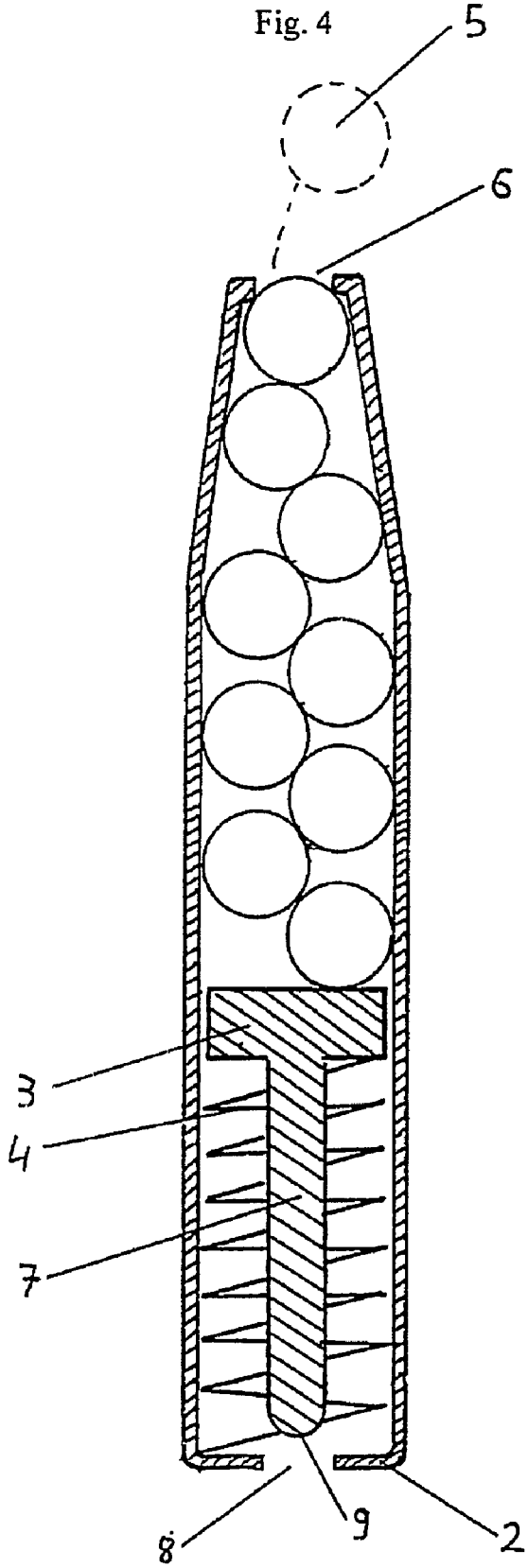
FIG. 4 depicts the magazine of FIG. 3 after a single bullet was removed.

FIG. 4 depicts the magazine of FIG. 3 after the first bullet (which was the last to be charged into the magazine) was discharged from the magazine into the muzzle, when all but one of the maximal number of bullets are present in the magazine. At the instance the first bullet is missing, follower 3 advances towards the opening 6 of the magazine, thus causing tip 9 of pin 7 to retract into the body of the magazine and disappear within the magazine, being no linger visible or noticeable. If the bottom of the magazine is felt it immediately becomes obvious that the magazine is no longer full with bullets, giving rise to the probable assumption that there is a bullet inside the muzzle of the firearm. If this status is undesired or unintentional, the carrier of the firearm will immediately perform check-up of his firearm to make sure there is no bullet in the muzzle, removing any bullet from the muzzle, if there was one.

Figure 5:
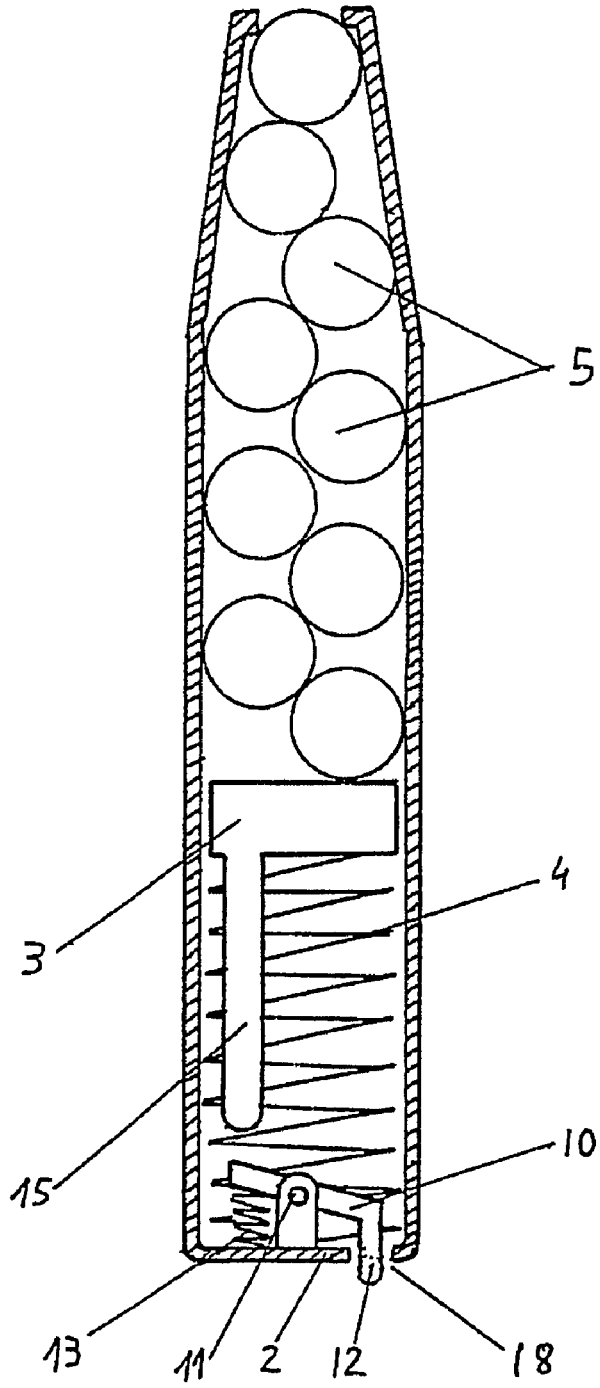
FIG. 5 illustrates a firearms magazine with status indicator in accordance with another preferred embodiment of the present invention, with a resilient levered indicator.

FIG. 5 illustrates a firearms magazine with status indicator, in accordance with another preferred embodiment of the present invention, with a resilient levered indicator. Resilient lever 10 is pivotally attached to base 11, provided on the bottom of housing 2 of the magazine, the resilient lever 10 provided with prominence 12. The default position of the resilient lever is determined by spring 13 to be with prominence 12 protruding through bore 18, provided at the bottom of the housing of the magazine. When the maximum number of bullets is reached, follower 3 is retracted into the magazine and pin 15 presses against resilient lever 10 forcing prominence 12 to disappear into bore 18. The carrier of the magazine (and its corresponding firearm) can therefore determine if the magazine is full (when prominence 12 is invisible), or if one, or more, bullets is missing (when prominence 12 is visible), suggesting that a thorough examination of the muzzle ought to be performed on the firearm muzzle.

Figure 6:
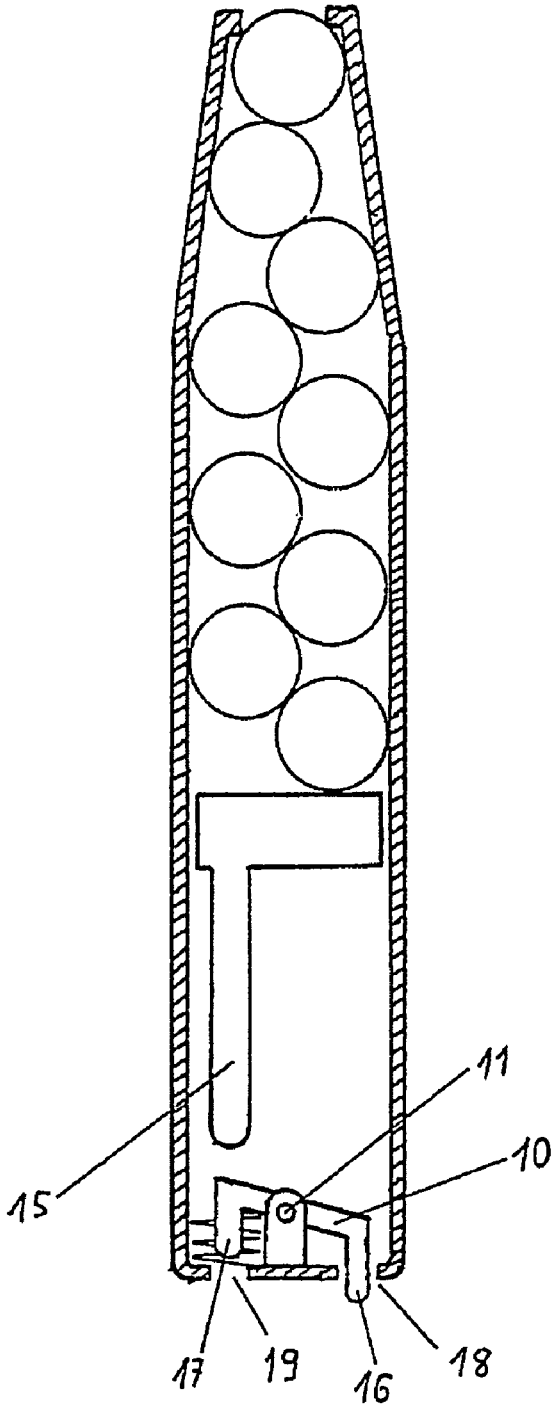
FIG. 6 illustrates a firearms magazine with status indicator in accordance with another preferred embodiment of the present invention, with two colored indication pins.

FIG. 6 illustrates a firearms magazine with status indicator in accordance with another preferred embodiment of the present invention, with two colored indication pins. Here a resilient lever 10 is provided with two prominences, 16, 17, each on either end of the resilient lever. The default position of the resilient lever is determined by spring 13 to be with prominence 16 protruding through bore 18, provided at the bottom of the housing of the magazine, whereas prominence 19 is retracted behind bore 19, at the bottom of the magazine. When the maximum number of bullets is reached, follower 3 is retracted into the magazine and pin 15 presses against resilient lever 10 forcing prominence 16 to disappear into bore 18, and pushing prominence 17 to appear through bore 19. The carrier of the magazine (and its corresponding firearm) can therefore determine if the magazine is full (when prominence 17 is visible), or if one, or more, bullets is missing (when prominence 16 is visible), suggesting that a thorough check-up of the muzzle be performed on the firearm muzzle. In a preferred embodiment of this arrangement the prominences are differently colored, so as to allow fast and reliable determination of the filling status of the magazine. In another preferred embodiment of this arrangement the prominences may be distinctly shaped (e.g. one prominence presenting a flat surface, whereas the second presents a rough surface, or one prominence roundly shaped whereas the other sharply shaped, etc.). In yet another embodiment of the present invention, the protruding lengths of the prominences may differ to allow fast and better distinction between the magazine states.

Figure 7:
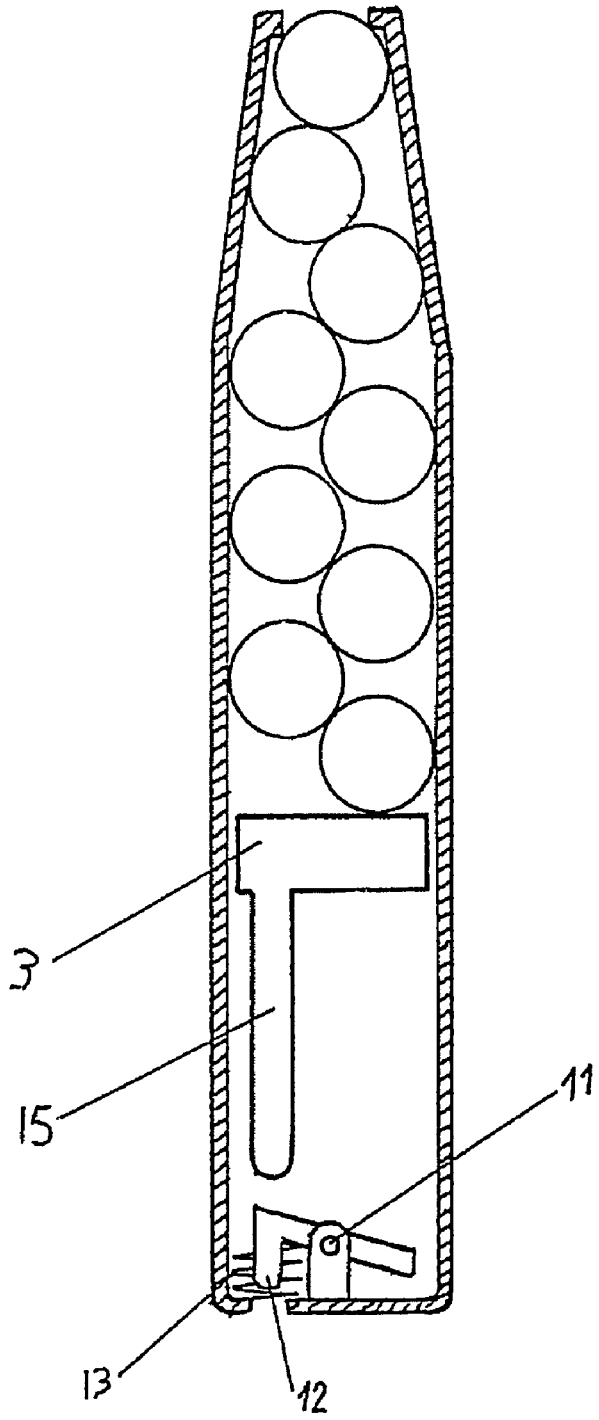
FIG. 7 illustrates a firearms magazine with status indicator in accordance with another preferred embodiment of the present invention, with a resilient levered indicator.

FIG. 7 illustrates a firearms magazine with status indicator in accordance with another preferred embodiment of the present invention, with a resilient levered indicator. Here the prominence 12 is engulfed by a spring 13, which renders the default position of the indicator hidden inside the magazine, unless the magazine is full, in which case the pin 15 presses prominence 12 out to appear. In this magazine the indicator appears when the magazine is full and disappears when it is short of the maximal number of bullets it can hold when full.

Figure 8:
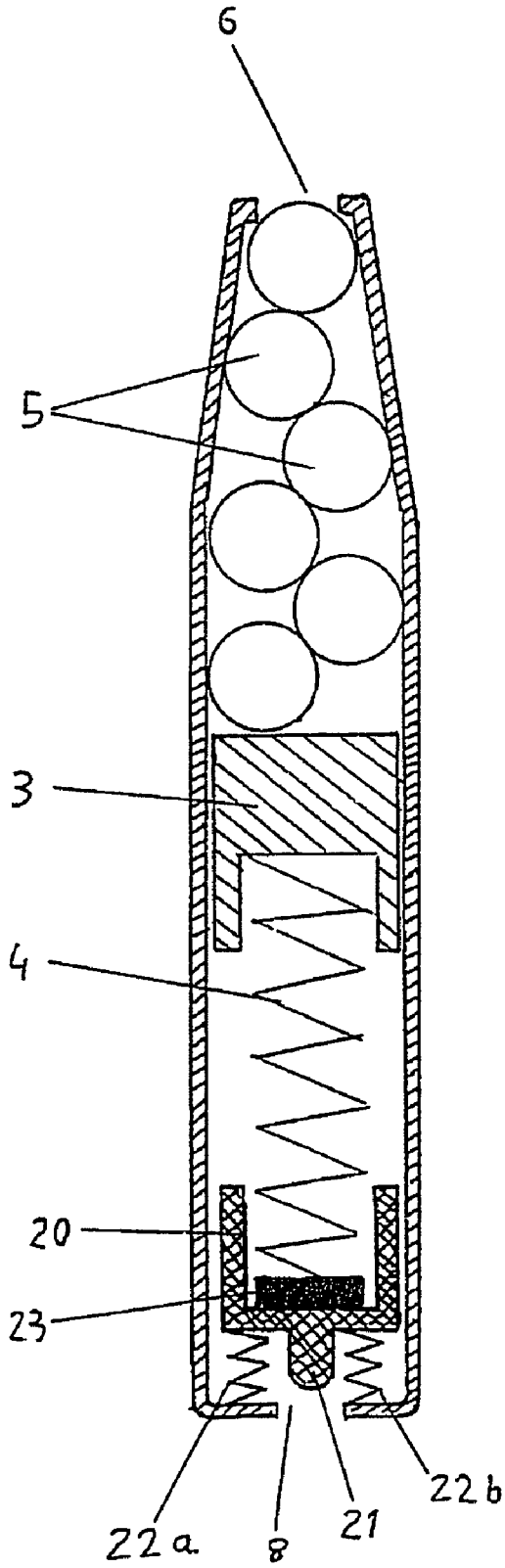
FIG. 8 illustrates a firearms magazine with status indicator in accordance with another preferred embodiment of the present invention, with a resiliently floating indicator, partially full with bullets.
Figure 9:
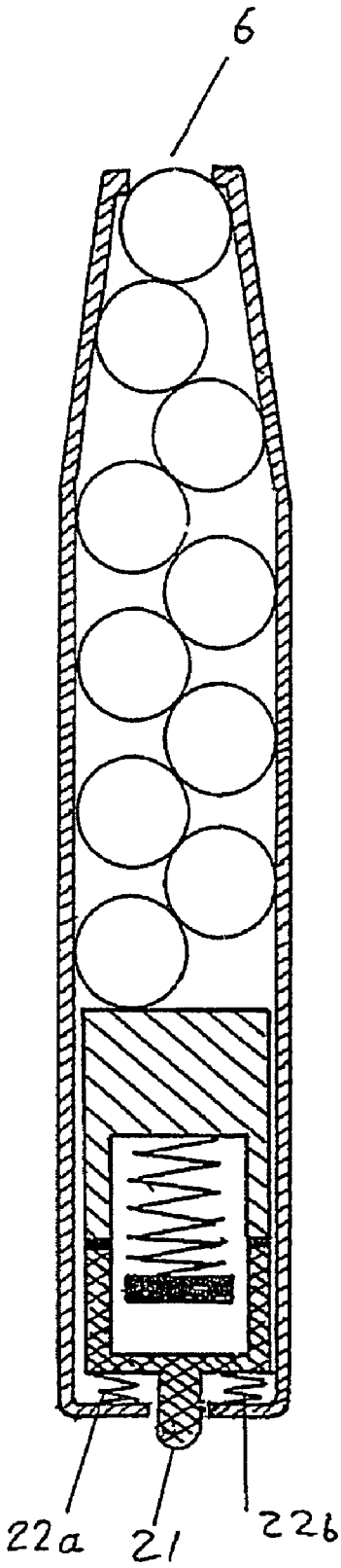
FIG. 9 illustrates the firearms magazine of FIG. 8, full with bullets.

FIG. 8 illustrates a firearms magazine with status indicator in accordance with another preferred embodiment of the present invention, with a resiliently floating indicator, partially full with bullets. Spring 4, which presses follower 3 in the opening 6 direction, ends at a fixed anchoring position 23. Floating member 20, here U-shaped (this shape is optional), is provided with a prominence 21 at its bottom, and is supported by twin springs 22*a*, 22*b*, so that when no force is exerted on the floating member from atop the prominence is hidden inside the magazine, as seen in this figure. FIG. 9 illustrates the firearms magazine of FIG. 8, full with bullets. When the magazine is full with bullets, follower 3 presses the floating member down forcing prominence 21 out of bore 8 to appear.

Figure 10:
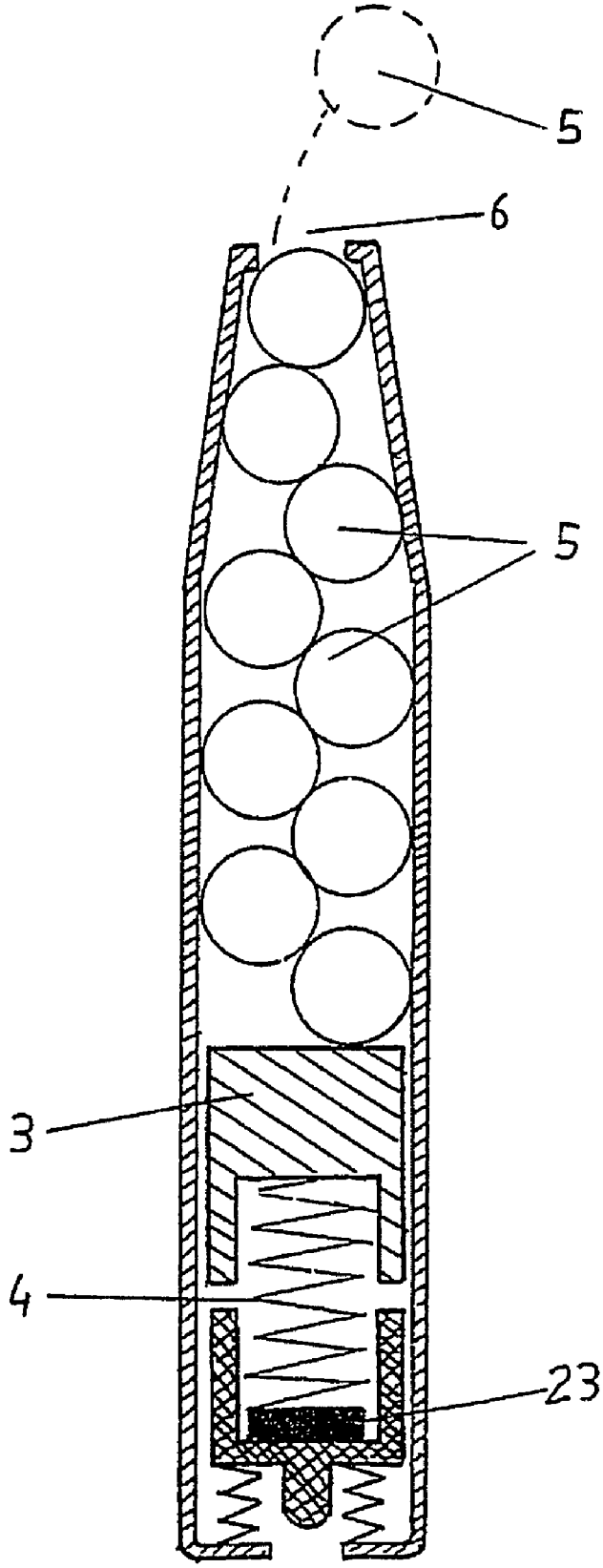
FIG. 10 illustrates the firearm magazine of FIG. 9 short of one bullet.

FIG. 10 illustrates the firearm magazine of FIG. 9 short of one bullet. When even as little as one bullet (the first one) is removed the prominence retracts into the magazine.

The indicator member may be subjected to an inadvertent blow, which may have the potential to harm the magazine or the bullets stacked inside. In order to reduce this hazard it is suggested, in some preferred embodiments of the present invention, to employ a shock-absorbing feature.

In a preferred embodiment of the present invention, the prominence may be made from elastic material, such as rubber or plastic (or other elastic materials).

Figure 11A:
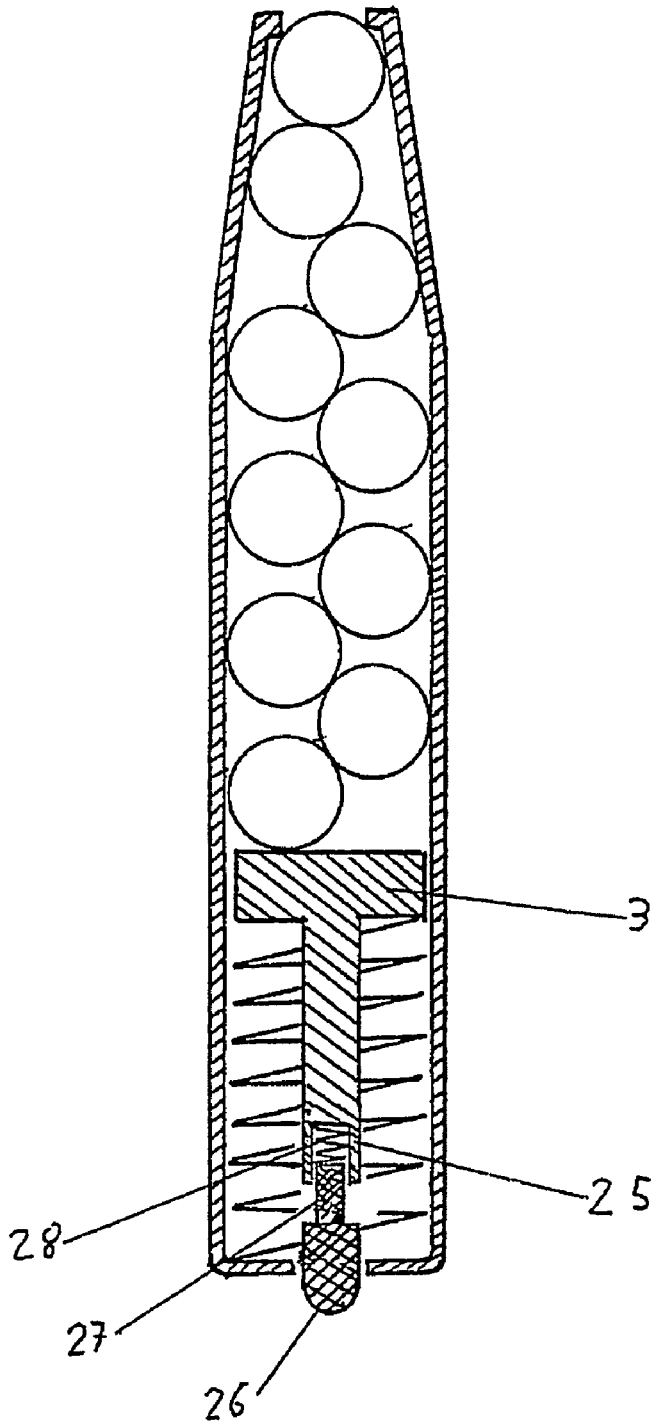
FIG. 11*a* illustrates an embodiment of a soft-tip indicator incorporated in a follower.

FIG. 11*a* illustrates an embodiment of a soft-tip indicator incorporated in a follower. Here follower 3 is provided with a hollow protrusion 25 into which matching stem 27 of a bulbous head 26 is inserted, provided with spring 28 that keeps the bulbous head 26 extended. However, if the head is subjected to a blow it retracts as the stem slides into the hollow protrusion, to be back out again when the force ceases to act on the head.

Figure 11B:
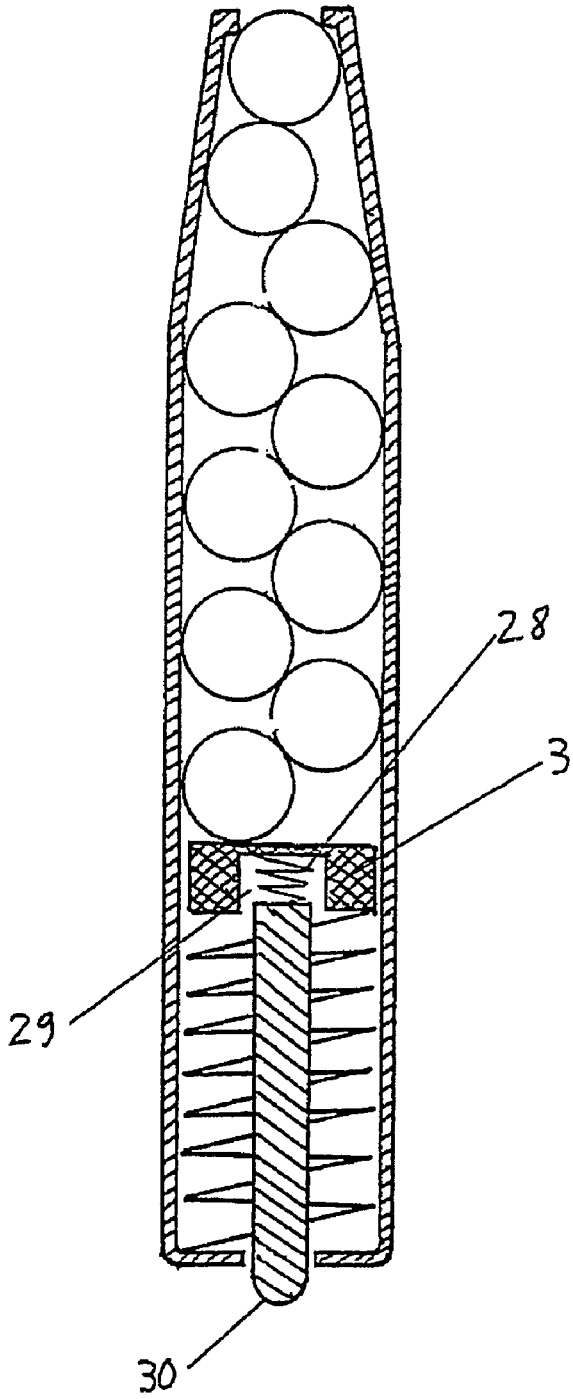
FIG. 11*b* illustrates another embodiment of a soft-tip indicator incorporated in a follower.

FIG. 11*b* illustrates another embodiment of a soft-tip indicator incorporated in a follower. Here support member 3 is provided with a cavity 29 into which pin 30 is inserted, held extended out with the aid of spring 28. When subjected to a force on the tip it partially retracts into the cavity, thus absorbing the shock.

Figure 11C:
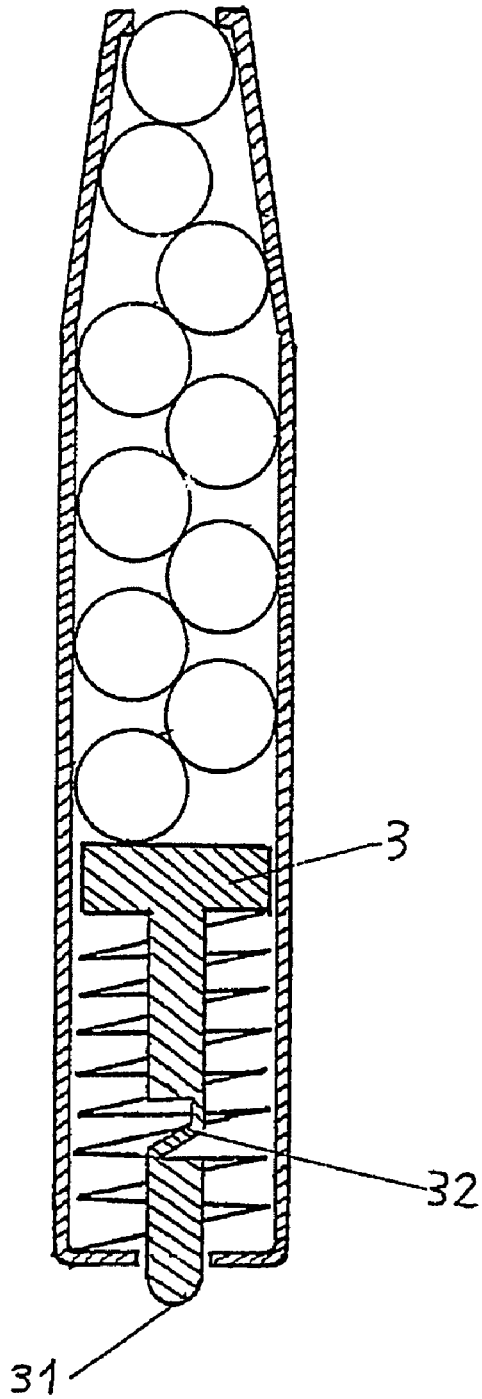
FIG. 11*c* illustrates yet another version of a soft-tip indicator incorporated in a follower.

FIG. 11*c* illustrates yet another version of a soft-tip indicator incorporated in a follower. Here the very structure of pin 31 is designed to absorb shocks by providing a tortuous pin. In order to work properly the pin has to be made from a relatively flexible material, such as plastics, or else it would snap.

Figure 12A:
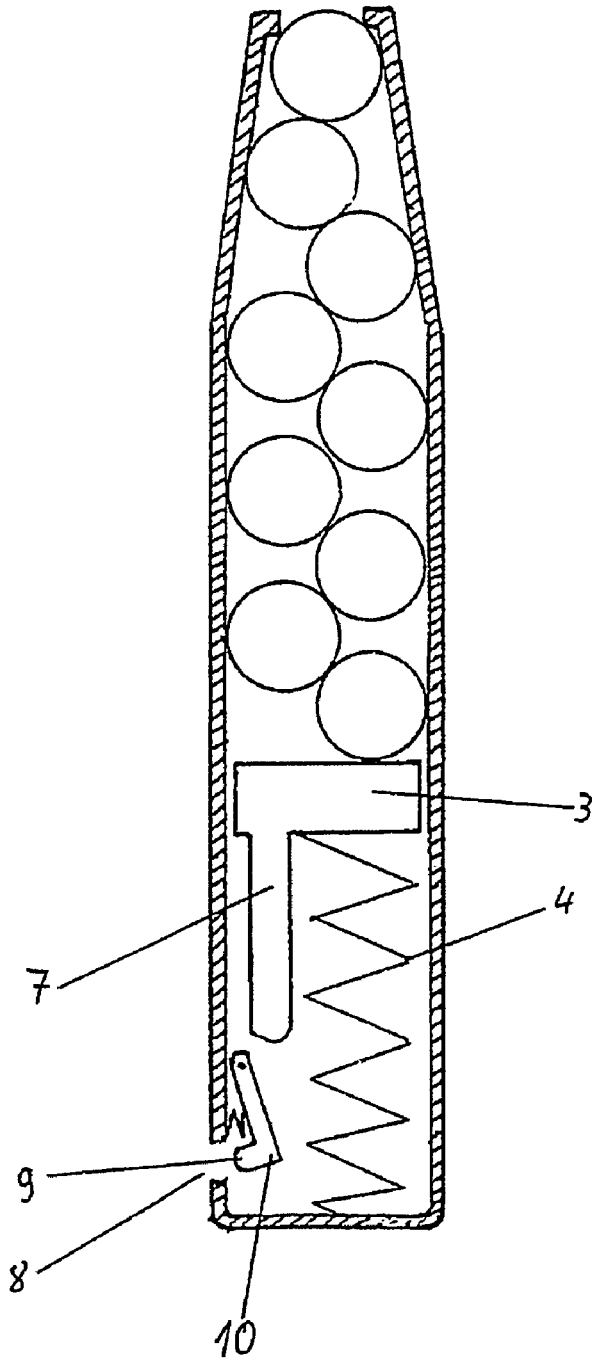
FIG. 12*a* illustrates a firearm magazine with a lateral status indicator, indicating that the magazine is not full.

FIG. 12*a* illustrates a firearm magazine with a lateral status indicator, indicating that the magazine is not full. Here bore 8 is provided on the side-wall of magazine 1, and the indicator tip 9 is inside magazine 1 when the magazine is short of one or more bullets from a full position.

Figure 12B:
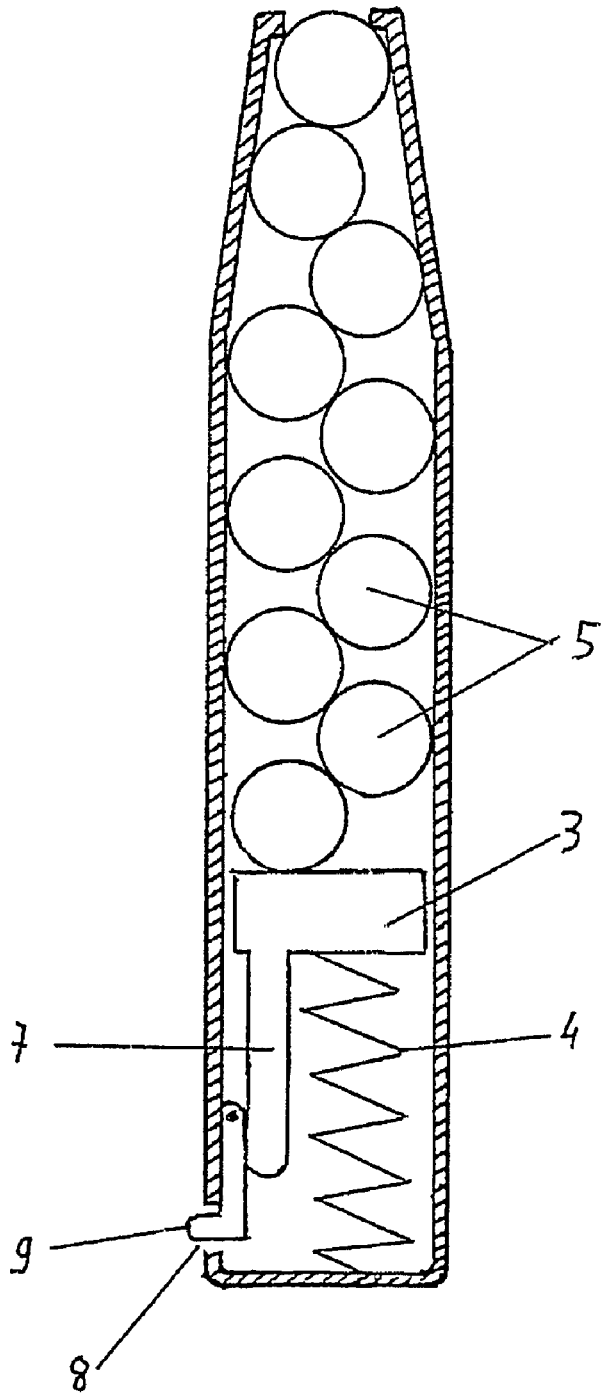
FIG. 12*b* illustrates the magazine of FIG. 12*a*, when the magazine is full, with the status indicator indicating that the magazine is full.

FIG. 12*b* illustrates the magazine of FIG. 12*a*, when the magazine is full, with the status indicator indicating that the magazine is full. In this case tip 9 protrudes through bore 8.

Figure 13:
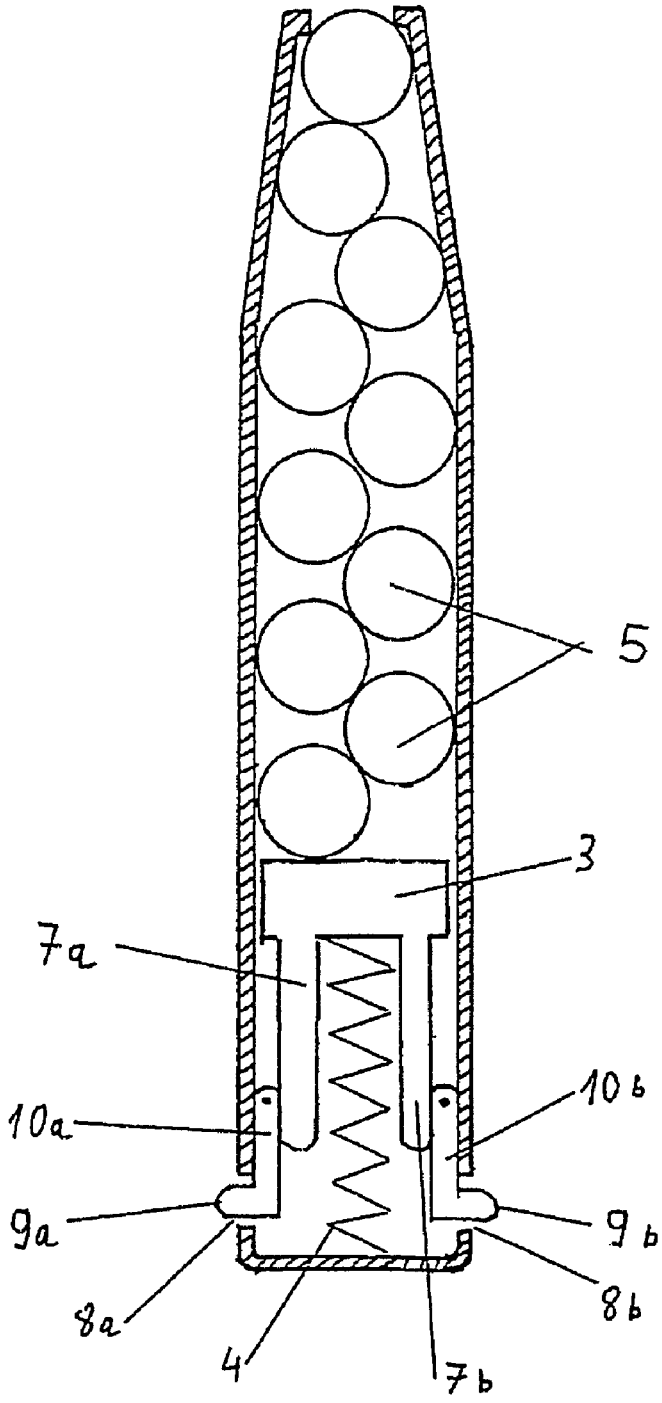
FIG. 13 illustrates a firearm magazine with two lateral status indicators.

FIG. 13 illustrates a firearm magazine with two lateral status indicators. Here the magazine is provided with indicators on opposite, lateral walls of the magazine, allowing the user to feel the magazine on either of its lateral walls, in order to determine the status of the magazine. Follower 3 is provided with two prominences 7*a*, 7*b*, which cooperate with resilient levers 10*a*, 10*b* (respectively), to present the tips 9*a*, 9*b* (respectively) either outside or inside bores 8*a* 8*b* (respectively), according to the loading status of the magazine.

In a preferred embodiment of the present invention the indicator pin may be removable and provided in various lengths, corresponding to different number of bullets in the same magazine, allowing users to determine what should be the number of bullets they wish to carry in their magazine and consider it as "full".

Note that the shock-absorbing arrangements shown in FIGS. 8, 9, 10, 11*a*, 11*b*, 11*c*, are only examples, and a shock-absorbing feature may also be implemented in different variations. The scope of the present invention is not limited to the examples shown only and covers any such variations.

Also note that bottom or lateral indicators may be used alternatively or jointly on the same magazine, and in fact the location of the indicator (or indicators) is not limited to a certain portion of the magazine but it is possible to implement the indicator in any portion of the magazine that is visible or accessible by the firearm-bearer to feel.

Note that the mechanical arrangements shown in the figures are merely some suggested embodiments of the present invention, and it is understood that a person skilled in the art could easily make some amendments to these embodiments and yet remain within the scope of the present invention.

It should be clear that the description of the embodiments and attached Figures set forth in this specification serves only for a better understanding of the invention, without limiting its scope as covered by the following Claims.

It should also be clear that a person skilled in the art, after reading the present specification could make adjustments or amendments to the attached Figures and above described embodiments that would still be covered by the following Claims.

The invention claimed is:

1. A firearm magazine with loading status indicator, the magazine comprising:

a housing for storing bullets in a stacked configuration, with an opening for receiving the bullets, a follower for supporting the bullets within the housing, movable along the housing and resiliently pressing towards the opening, so that at any time, when there exist at least one bullet within the housing it is presented at the opening, ready to be discharged;

an indicator comprising a prominence coupled to and protruding from the follower, for indicating one of two indication states, in which in one indication state the indicator protrudes outside a bottom wall of the housing and in another indication state the indicator does not protrude outside the bottom wall of the housing, wherein one of the indication states corresponds to a state where the magazine is in a full condition, that is when it is filled with bullets up to a maximal capacity, and another indication state corresponding to a state where at least one bullet is missing with respect to the full condition.

2. The magazine of claim 1, wherein a bore is provided on the bottom wall of the magazine through which the indicator protrudes in one of the indication states.

3. The magazine of claim 2, wherein the indicator is integrated with the follower.

4. The magazine of claim 3, wherein a shock absorbing feature is incorporated in the indicator.

5. The magazine of claim 4, wherein the shock absorbing feature comprises a spring.

6. The magazine of claim 4, wherein the shock absorbing feature comprises a pin with a resilient structure.

7. The magazine of claim 4, wherein the shock absorbing feature comprises a pin made of elastic material.

8. The magazine of claim 1, wherein the prominence is located on a bottom surface of the follower, wherein a bore is provided on the bottom wall of the magazine though which the prominence protrudes in one of the indication states, and wherein the prominence is hidden inside the housing at all times except when the magazine is in the full condition, filled with bullets up to the maximal capacity.

9. The magazine of claim 8, wherein a shock absorbing feature is incorporated in the prominence.

10. The magazine of claim 9, wherein the shock absorbing feature comprises a spring.

11. The magazine of claim 9, wherein the shock absorbing feature comprises a pin with a resilient structure.

12. The magazine of claim 1, wherein when the magazine is in full condition the indicator protrudes outside a bore in the bottom wall of the housing, and when at least one bullet is missing with respect to the full condition the indicator does not protrude.

13. The magazine of claim 12, wherein the bore is located on the bottom surface of the housing.

14. The magazine of claim 1, wherein when the magazine is in full condition the indicator does not protrude outside a bore in the housing, and when at least one bullet is missing with respect to the full condition the indicator protrudes outside the bore.

15. The magazine of claim 1, wherein the prominence is linked to the follower.

16. The magazine of claim 15, wherein the prominence is replaceable.

17. The magazine of claim 1, wherein the indicator is provided on an end of a resilient lever pivotally attached to the housing, cooperating with the follower.

18. The magazine of claim 17, wherein a second indicator is provided on another end of the resilient lever, so that when one indicator protrudes through the bore the second indicator is retracted, and when the one indicator is retracted the second indicator protrudes through a second bore at the housing.

19. The magazine of claim 18, wherein each indicator is colored distinctly.

20. The magazine of claim 18, wherein each indicator is distinctly shaped.

21. The magazine of claim 18, wherein each indicator has a different protrusion length.

22. The magazine of claim 1, wherein the indicator comprises a floating member.

23. The magazine of claim 22, wherein the floating member is resiliently supported.

24. The magazine of claim 1, wherein a shock absorbing feature is incorporated in the indicator.

25. The magazine of claim 24, wherein the shock absorbing feature comprises a spring.

26. The magazine of claim 24, wherein the shock absorbing feature comprises a pin with a resilient structure.

27. The magazine of claim 24, wherein the shock absorbing feature comprises a pin made of elastic material.

28. The magazine of claim 1, wherein the indicator comprises a plurality of indicators.

* * * * *